US009409184B1

(12) United States Patent
Mickelson et al.

(10) Patent No.: US 9,409,184 B1
(45) Date of Patent: Aug. 9, 2016

(54) PORTABLE SAND PLANT, SYSTEMS AND METHODS

(71) Applicant: GreyHawk Design and Fabrication, Inc., Eau Claire, WI (US)

(72) Inventors: John Mickelson, Eau Claire, WI (US); Adam Stolt, Eau Claire, WI (US)

( * ) Notice: Subject to any disclaimer, the term of this patent is extended or adjusted under 35 U.S.C. 154(b) by 0 days.

(21) Appl. No.: 14/814,079

(22) Filed: Jul. 30, 2015

Related U.S. Application Data

(60) Provisional application No. 62/064,564, filed on Oct. 16, 2014.

(51) Int. Cl.

| | |
|---|---|
| ***B03B 9/00*** | (2006.01) |
| ***B03B 5/62*** | (2006.01) |
| ***B03B 7/00*** | (2006.01) |
| *B07B 1/00* | (2006.01) |

(52) U.S. Cl.
CPC ... *B03B 5/62* (2013.01); *B03B 7/00* (2013.01); *B03B 9/00* (2013.01); *B07B 1/005* (2013.01)

(58) Field of Classification Search
CPC ..... B03B 5/623; B03B 5/66; B03B 7/00; B03B 9/00; B03B 9/02; B07B 1/005; B07B 2230/01
USPC ..... 209/420, 421, 935
See application file for complete search history.

(56) References Cited

U.S. PATENT DOCUMENTS 3,909,401 A * 9/1975 Thompson ..... B07B 1/46 209/412
4,249,351 A 2/1981 Brock
4,340,143 A * 7/1982 Moshofsky ..... A23N 12/026 209/158
4,579,496 A * 4/1986 Gerlach ..... B28C 7/0495 366/18
4,775,275 A * 10/1988 Perry ..... B28C 7/0495 366/18
5,049,261 A * 9/1991 Tapp ..... B03B 9/00 209/11
5,362,193 A * 11/1994 Milstead ..... B65D 88/30 414/332
5,811,016 A * 9/1998 Zierler ..... B01D 21/0018 210/194

(Continued)

OTHER PUBLICATIONS

CEMCO, Inc.; Vertical Shift Impacts (VSI) Crushers; McLanahan, CEMCO Build First Portable Frac Sand Plant; Jun. 11, 2012, http:/ www.cemcoturbo.com/news_frac.html, CEMCO, Inc., US.

(Continued)

*Primary Examiner* — Joseph C Rodriguez
(74) *Attorney, Agent, or Firm* — Anthony J. Bourget

(57) ABSTRACT

A portable plant, systems and methods for processing material, the plant having a chassis configured to connect to a truck to transport the plant on a roadway, the chassis having wheels and a base frame, an uppermost portion of the base frame positioned below an uppermost portion of the wheels, a first material processing device such as a hydrosizer mounted to a tower structure, the tower structure rotatably fixed to the base frame, and a hydraulic cylinder connected to the base frame and to the tower structure where operation of the cylinder causes the hydrosizer and the tower to adjust between a generally horizontal orientation where the hydrosizer is generally horizonatally oriented or rests on the base frame and a generally vertical orientation. The hydrosizer may be a cone-shaped hydrosizer and the wheels may be associated with a removable suspension and the chassis is configured to rest on the ground and receive additional processing components for use in a processing mode where the additional components are placed on a position of the chassis vacated by the elevated first material processing device.

22 Claims, 12 Drawing Sheets

(56) References Cited

U.S. PATENT DOCUMENTS 6,082,548 A * 7/2000 Stephenson ..... B03B 5/623 134/25.1
6,152,308 A * 11/2000 Kreiser ..... B07B 4/02 209/137
6,186,654 B1 2/2001 Gunteret, Jr.
6,293,689 B1 9/2001 Guntert, Jr.
6,527,428 B2 3/2003 Guntert, Jr.
6,991,361 B2 * 1/2006 Flood ..... B28C 7/0486 366/18
7,461,746 B1 * 12/2008 Egge ..... B02C 21/02 209/268
8,636,149 B2 * 1/2014 Craig ..... B03B 5/52 209/159
8,926,252 B2 1/2015 McIver
9,045,071 B2 * 6/2015 Nicholls ..... B60P 3/14
2012/0318720 A1 * 12/2012 Whitley ..... E01H 12/002 209/235
2015/0135636 A1 * 5/2015 Ayres ..... B07B 15/00 52/745.03

OTHER PUBLICATIONS

Hot-Mix Magazine; The New Big Name in Concrete Plants; Portable, Versatile, and Dependable Quality, Magazine, 2010, Cover Page, pp. 18-19, 15(1), Astec Industries, Inc., US.

* cited by examiner

PORTABLE SAND PLANT, SYSTEMS AND METHODS

CROSS-REFERENCE TO RELATED APPLICATIONS

This application claims the benefit and priority of Provisional Patent Application Ser. No. 62/064,564 filed Oct. 16, 2014, for PORTABLE HYDRAULIC FRACTURING SAND PLANT AND METHODS under 35 U.S.C. §119(e), incorporated herein by reference in its entirety for continuity of disclosure.

DESCRIPTION

Background of the Invention

1. Field of the Invention

The present invention relates to material processing plants, material processing systems and material processing methods, and particularly portable sand plants, systems and methods utilized for processing hydraulic fracturing material.

2. Background Information

Hydraulic fracturing utilizes special sand which is delivered with fracturing fluid during a hydrofracing operation. Obtaining and using the sand having desired properties is important to the success of the hydraulic fracturing process. Sand plants are used to separate the desired sand from unwanted materials. Typically a sand plant is a fixed-location facility where sand is transported to the facility for sorting and cleaning. The selected sand is stacked and/or transported to a location for use in the hydraulic fracturing process to extract gas and/oil from the ground.

There exists at least one portable sand plant designed by CEMCO for separating desired frac sand. While the CEMCO prior art portable sand plant may have useful features, there is room for improvement.

SUMMARY OF THE INVENTION

The inventors have created an efficient, portable material processing plant, systems and related methods.

All or nearly all major processing plants use a cone-shaped hydrosizer for fractionating sand. Yet all of such plants are stationary or non-portable. While a taller, more efficient hydrosizer is highly desired, it presents problems when attempting to transport, set-up, stabilize and operate (and makes overall construction of a processing facility difficult, expensive and time consuming). Traditional non-portable sand plants that use a hydrosizer and especially a cone-shaped hydrosizer require a long time for set-up and preparation. A major component of the set-up and construction of such plants includes having to weld various components together, which substantially increases the time and expense for set-up. Such construction is also conducted at an outdoors environment which typically causes additional delay and expense due to weather conditions. A typical sand processing plant also uses several material processing devices, and these devices are usually arranged in ways that occupy a relatively large or inefficient footprint or lack a uniform or in-line compact arrangement.

Heretofore there have been no systems which utilize a cone-shaped hydrosizer in a portable context, or utilize pre-assembly of a cone-shaped hydrosizer for tip-in-place construction of a material processing plant. Heretofore there also has been no utilization of the space on a chassis which space is vacated by action of a tip-up material processing device where an additional processing device is placed at the vacated location, the additional processing device supplying material to the first material processing device. Heretofore there also have been no systems which present a complete solution for processing frac sand where the key material processing components used in of the process are configured on a single chassis or configured with an in-line arrangement on a single chassis. The present invention makes these and other uses possible.

In accordance with an aspect of the invention, a hydrosizer is positioned on a portable chassis which chassis also includes key processing equipment for a sand processing operation. For instance, in addition to a cone-style hydrosizer, the chassis includes an initial wet screen, at least one attrition cell, and a dewatering screen all positioned on or positionable on the chassis. The chassis is portable and configured to be placed directly on the ground. An initial wet screen separates sand material to be sent to the attrition cell which scrubs or removes organics or clays and other unwanted materials from the sand particles before the sand is treated in the hydrosizer which further separates the sand. The sand exits the hydrosizer and is dewatered at a screen device also placed on the chassis. All of these components (wet screen, attrition cell, hydrosizer, and dewatering screen, together with related pumps and delivery devices) are arranged in-line on the chassis for an efficient processing operation and also for efficient assembly/construction of the processing plant.

In accordance with a further aspect of the invention, a chassis includes a tip-up hydrosizer and is configured such that additional sand processing components may be placed on the chassis for a processing operation. The chassis includes a wheel suspension and a goose-neck for transport of the sand plant on a roadway or other surface. In one aspect the chassis includes a base frame configured to rest upon the ground.

In a further aspect the invention includes a method of utilizing the portable sand plant including raising the chassis and removing a wheel suspension and then lowering the chassis such that the base frame rests upon the ground. Thereafter the hydrosizer is tipped-up into operational position and other processing equipment added to the chassis.

In a further aspect of the invention includes configuring the chassis such that the hydrosizer rests on a base frame during a transport mode where the base frame is positioned lower than a goose neck at a first end of the chassis and below a rear frame at a second end of the chassis.

A further aspect of the invention includes a portable material processing plant having a chassis configured to connect to a truck to transport the plant on a roadway, and a cone-style hydrosizer mounted to a tower structure rotatably connected to the chassis such that the hydrosizer is moveable from a horizontal orientation to a vertical orientation.

Additional aspects of the invention are provided herein.

The above partial summary of the present invention is not intended to describe each illustrated embodiment, aspect, or every implementation of the present invention. The figures and detailed description and claims that follow more particularly exemplify these and other embodiments and further aspects of the invention.

BRIEF DESCRIPTION OF THE DRAWINGS

The invention may be more completely understood in consideration of the following description of various embodiments of the invention in connection with the accompanying drawings, in which.

Figure 1:
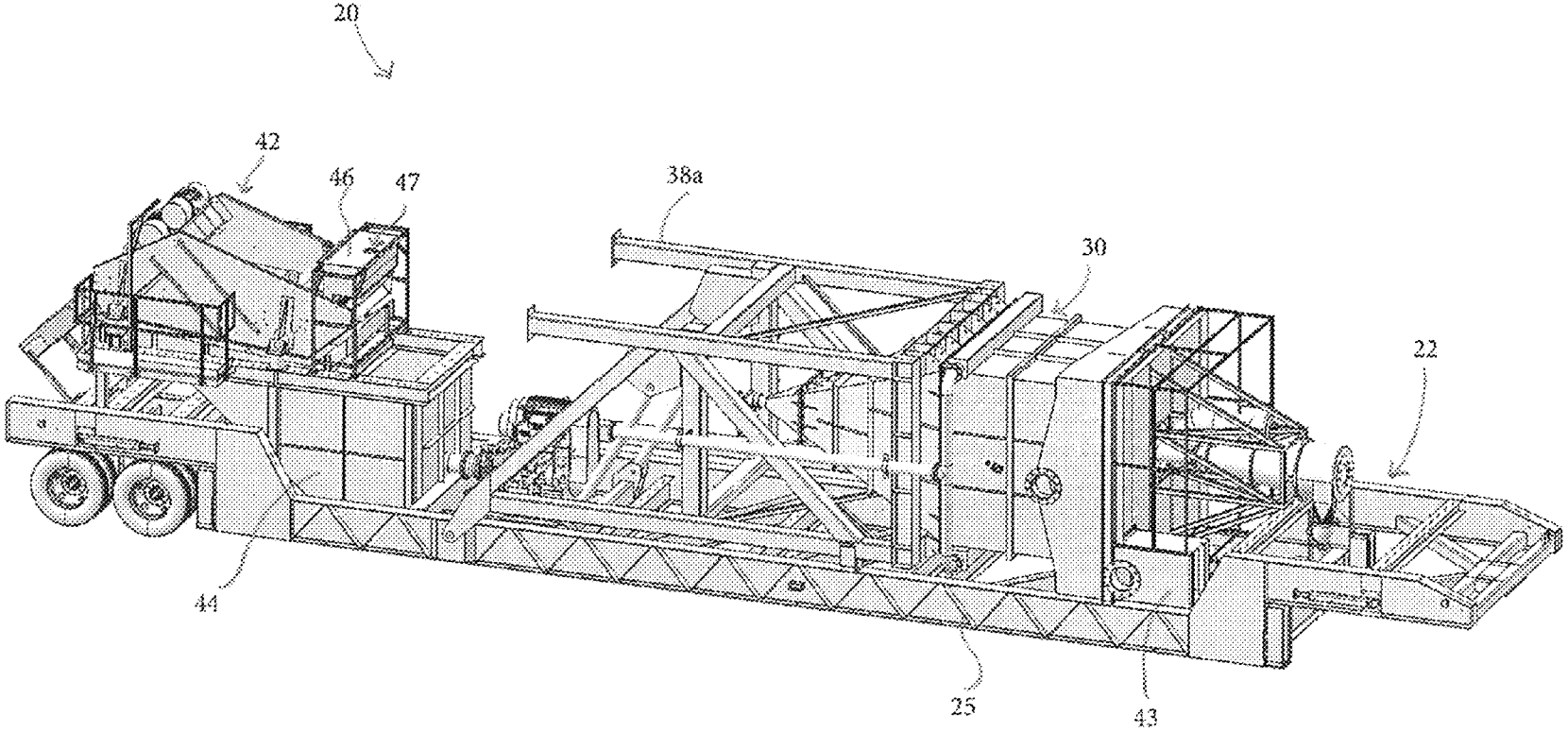
FIG. 1 is a perspective view of a portable material processing plant in accordance with one aspect of the present invention.

While the invention is amenable to various modifications and alternative forms, specifics thereof have been shown by way of example in the drawings and will be described in detail. It should be understood, however, that the intention is not necessarily to limit the invention to the particular embodiments, aspects and features described. On the contrary, the intention is to cover all modifications, equivalents, and alternatives falling within the spirit and scope of the invention and as defined by the appended claims.

DETAILED DESCRIPTION OF THE INVENTION

Figure 2:
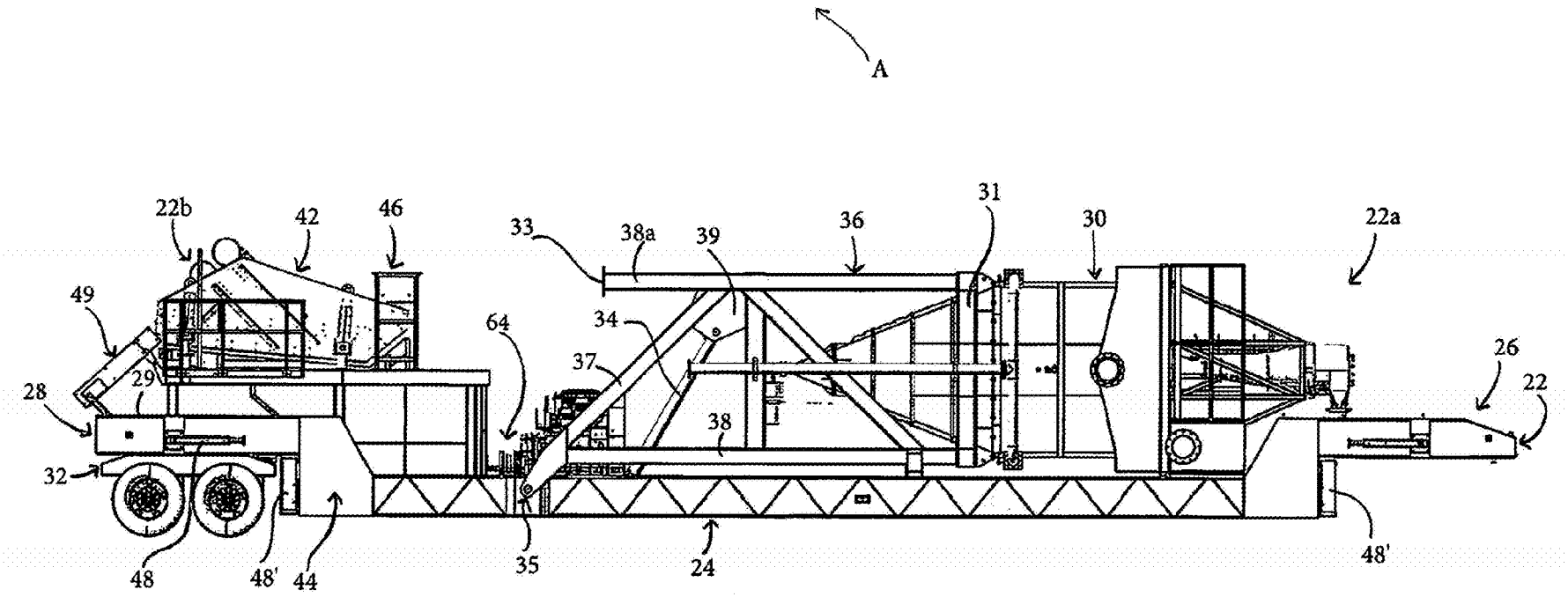
FIG. 2 is a side view of the processing plant of FIG. 1.

Referring to FIGS. 1-12, various aspects of the invention are shown. FIG. 1 is a perspective view showing one aspect of a portable material processing plant 20 having a chassis 22. In one aspect plant 20 is a portable sand processing plant. FIG. 2 shows a side view of plant 20. Chassis 22 is a version of a "drop deck" trailer and includes a base frame 24 with a goose neck 26 positioned at a first end 22*a* of chassis 22 and a rear frame 28 positioned at a second end 22*b* of chassis 22. Goose neck 26 is oriented generally horizontally and is positioned above base frame 24 which is also oriented generally horizontally. Rear frame 28 is also oriented generally horizontally and is positioned above base frame 24. In one aspect base frame 24 is positioned lower than rear frame 28 and goose neck 24. Rear frame 28 and goose neck 24 are elevated in relation to base frame 24. It may be appreciated that goose neck 26 is configured such that a hitch of a tractor-trailer truck may be positioned underneath or in association with goose neck 26 for connection and transport. Rear frame 28 is configured such that a frame suspension 32 may be positioned underneath rear frame 28. In one aspect frame suspension 32 includes wheels and is removeable. In one aspect chassis 22 is an approved over the road goose-neck or "drop-deck" type of trailer which is licensed, certified or otherwise authorized for legal transport down a roadway without the need to obtain special permits for transport. In one aspect chassis 22 is no greater than 73 feet in length and is less than 12 feet in width (or greater than 12 feet when considering the hydrosizer 30). Different lengths and widths may be used or established for chassis 22 without departing from the invention.

Figure 3:
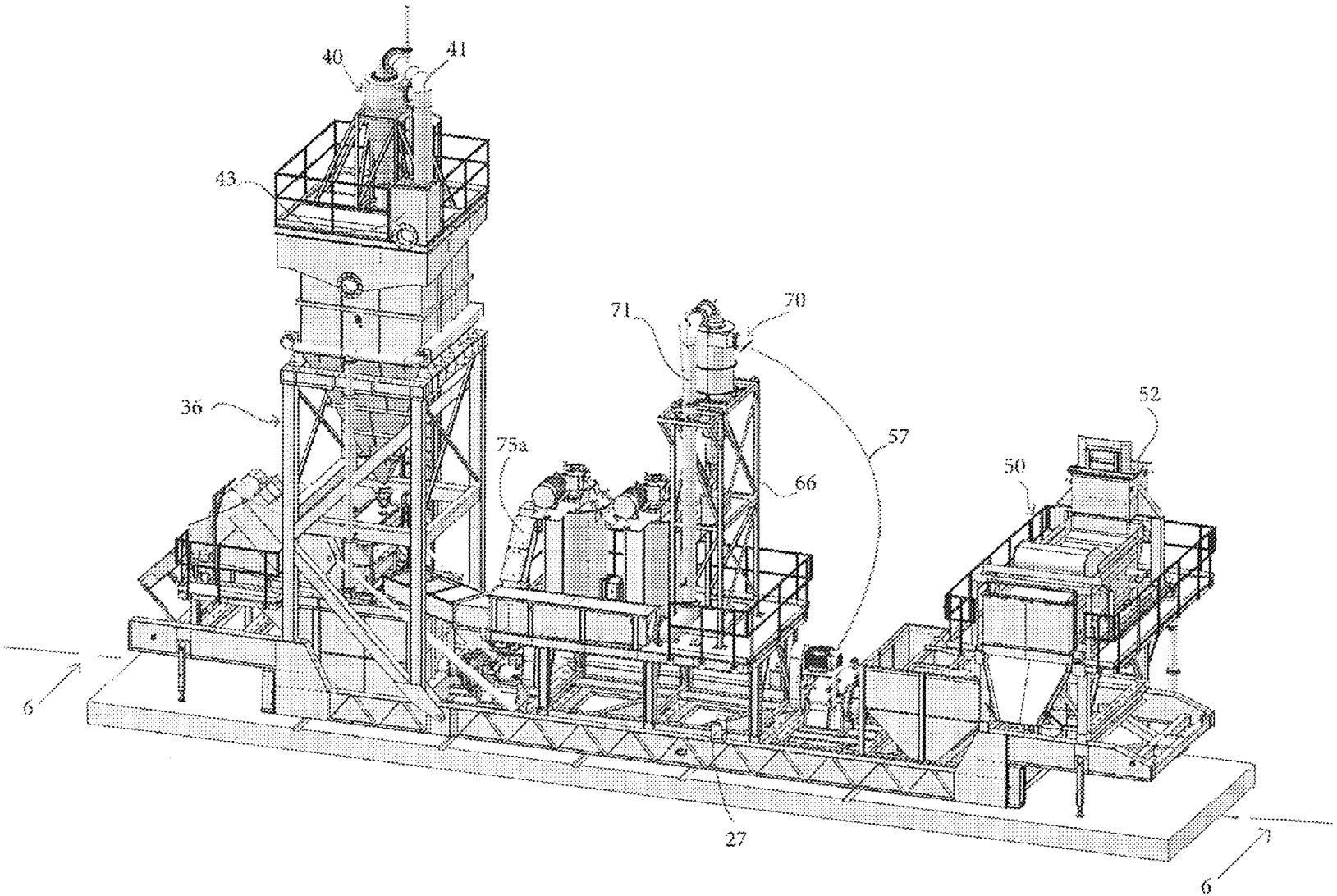
FIG. 3 is a perspective view of a further aspect of the invention.
Figure 4:
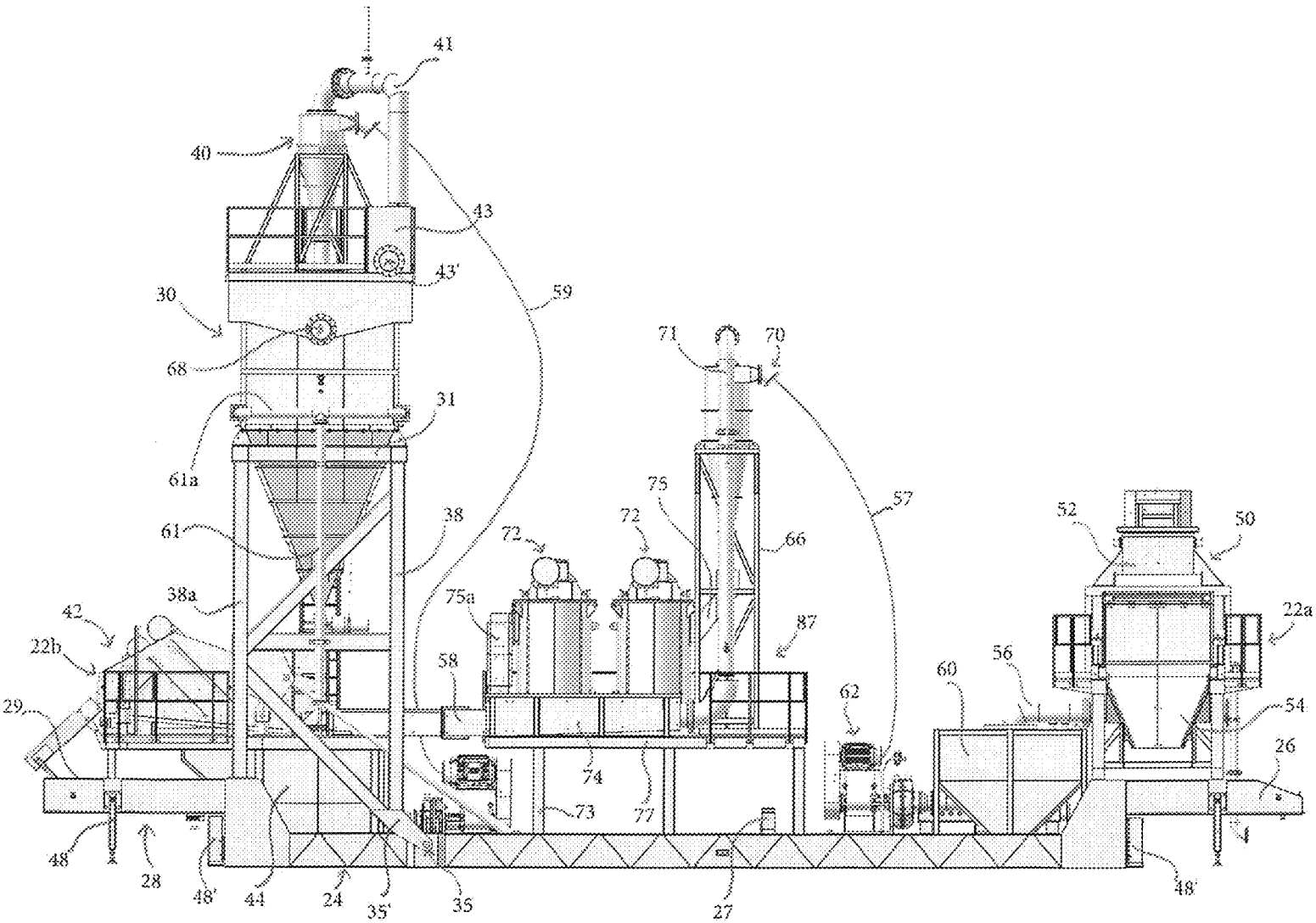
FIG. 4 is a side view of the processing plant of FIG. 3.

While FIG. 1 and FIG. 2 show aspects of the processing plant 20 in transport mode (or prior to assembly and operation), FIG. 3 and FIG. 4 show the plant 20 in one set-up mode option. General flow of material through plant 20 is described in the following non-limiting example: material such as dry sand and/or mixed sand and water (which may also include stones or other materials) is delivered (by conveyor or bucket or other delivery mechanism) to primary wet screen 50 where course materials are removed and where water is added to the remaining material to make a slurry which flows to sump 60. Course materials may be removed, for instance, by use of a screen (such as where primary wet screen 50 includes a bottom deck equipped with a screen of 12 mesh variety, i.e., 12 openings per linear inch, or a sieve size of 1.7 mm, thus only allowing particles smaller than 1.7 mm to pass through the screen). Different mesh sized may be used as desired. In one aspect, different mesh may include, but not limited to 18 mesh which includes a sieve size of 1.0 mm. A pump 62 delivers the slurry to separator 70 which removes water and fine materials and allows the heavier damp material to drop into attrition cell or cells 72. At cells 72 the material such as sand is treated by mixing and self-friction to remove small particles, clays, organics or other unwanted matter. The sand then drops to trough 74 and then into sump 44. The overflow water and small particles from separator 70 also drop to trough 74 and recombine with the material treated in cells 72 and then to sump 44. A slurry of water and material is positioned in sump 44. A pump 64 delivers the slurry mixture to cyclone separator 40 where overflow is separated through conduit 41 and delivered to box 43 or other location. The overflow contains water and small materials which may be discarded or subsequently separated or treated. The material within separator 40 which does not go to the overflow will drop thorough separator 40 and into hydrosizer 30. The treatment within hydrosizer 30 (and with the other mentioned components) is described in further detail below. Material drops down from hydrosizer 30 into a feed box 46 where it is delivered to a dewatering screen assembly 42. Material such as sand is dewatered and proceeds down a discharge chute 49 for storage or transport. The material delivered to screen assembly 42 is often the most desired product produced from the plant 20 (such as sand used in hydraulic fracturing). The overflow material from separator 40 may also be desired material so that additional processing may be arranged for such overflow. Different or additional processing devices may be used in conjunction with plant 20 and chassis 22. To assure a complete processing solution the four key components of a sand processing system under the present invention include 1) a primary or initial wet screen component for making an initial separation of the sand to pass the desired sand to 2) an attrition cell or tub wherein the sand is scrubbed for subsequent delivery to a 3) hydrosizer for particularly controlled separation of the sand which is completed by processing at a 4) dewatering screen and then passed to storage or delivery. Presenting the key components on a single chassis, and also arranging the components in-line on a chassis, is advantageous for many reasons as may be appreciated and as further described herein. Further aspects of plant 20 and the associated systems and methods of the invention are described.

In one aspect hydrosizer 30 is rotatably positioned on chassis 22. The hydrosizer 30 is configured to receive material, including sand, entering from a top portion. Hydrosizer 30 also receives water through supply water pipes 61, 61*a*. Hydrosizer 30 is a hindered settling classifier. Within hydrosizer 30 a column or layer of water pushes upward from the bottom area or middle portion of the hydrosizer 30. The injection water travels at a rate such that only selected particles are carried upward and out of the hydrosizer 30 while heavier and/or larger material or sand particles drop to the bottom of the hydrosizer 30 and exit from a port at the bottom.

Within the hydrosizer 30 materials are held in a state of "teeter" which comprises a narrow size band or area within the hydrosizer chamber. When particles that are larger (or heavier) enter the hydrosizer and into the band of teetering material, they drop to the bottom of the chamber and those materials that are finer or lighter are displaced to the overflow. By using an accurate sensing device with a constant flow of upward current water, well-defined separation of the input sand slurry is achieved. The pressure flow of water can be varied to alter the selected types or sizes of materials that are separated. In one aspect hydrosizer 30 may be a cone-styled hydrosizer 30. It may be appreciated that a flat bottom hydrosizer may also be used. A taller cone-type hydrosizer 30 is more efficient than a flat bottom variety yet requires additional space and handling.

In one aspect hydrosizer 30 may be calibrated to separate sand within a desired range of sizes, such as hydrosizer may allow particles of 12 by 70 mesh to pass or drop downward to feedbox and then into dewatering screen. The 70 by 140 mesh sized particles will pass through the overflow port 68 of hydrosizer 30. Hydrosizer may be configured so that the teeter point allows particles of sizes smaller or greater than 70 mesh to pass. The 12 by 70 sized particles may then be delivered to dewatering screen 42 for storage or delivery. The over flow from hydrosizer 30 may be further processed at a further cyclone separator and a screen to produce a 70 by 140 mesh sized product, for instance, and typically referred to as "100 mesh". The overflow from hydrosizer 30 may be sent to a supplemental treatment facility 98 for further processing and to produce, for instance, 100 mesh product.

In one aspect hydrosizer 30 is positioned on base frame 24. A hydraulic cylinder 34 is connected to base frame 24 and is configured to cause hydrosizer 30 to adjust between a generally horizontal orientation as shown in FIG. 1 and FIG. 2 and a generally vertical orientation as shown in FIG. 3 and FIG. 4. Hydrosizer 30 may be selectively raised (or tipped upward) or lowered as desired. In further aspect a crane or hoist may be used to move the hydrosizer 30 into position (by pivoting as described below or otherwise). In one aspect hydrosizer 30 is mounted to or in a tower structure 36. A top collar 31 is configured to receive hydrosizer 30. In one aspect collar 31 surrounds hydrosizer 30 generally where hydrosizer 30 begins to taper. Tower structure 36 includes support legs 38. Support legs 38 form a generally rectangular frame configured to hold and support hydrosizer 30. In one aspect a set of four legs 38 will hold hydrosizer 30. Cross supports 37 are used for structural support of tower 36. Cylinder 34 may connect to a gusset plate 39. Activation of cylinder 34 pushes against gusset plate 39 causing tower structure 36 to rotate upward in the direction of arrow A (See FIG. 2). Tower 36 connects to base frame 24 at a pivot 35. It may be appreciated that a pivot 35 is positioned on each side of chassis, and that two cylinders 34 may be utilized as desired. In one aspect pivot 35 includes a pin about which a support member pivots. Support leg 38, via pivot plate 35', pivots about pin 35. In one aspect support leg 38 may rest upon base frame 24. In another aspect support leg 38 may be slightly suspended from base frame 24 such that the pivot plate 35' and pivot 35 provide the supporting structure for leg 38. Support leg **38*a* includes a foot 33 which rests upon rear frame 28 when tower 36 is in an upright position. In an alternative aspect tower 36 may be positioned such that foot 33 rests upon base frame 24. Positioning tower 36 so that leg 38*a* rests on rear frame 28 accommodates for a greater open space area on chassis 22** for placement of additional material processing devices.

It may be appreciated that use of pivot plate 35' accommodates an efficient rotation of tower 36 while also allowing a clearance between hydrosizer 30 and chassis 22. For instance, in horizontal mode, tower structure 36 includes a support leg 38 which is oriented generally parallel to and in a spaced relationship with base frame 24. Leg 38 of structure 36 will engage with cradle 27, for instance. In one aspect the meeting of leg 38 with cradle 27 (together with pin 35) is the only point of contact between structure 36 and chassis 22. Such arrangement assists in creating clearance for hydrosizer 30 and related frames and structures from contacting chassis 22 during transport (to better protect against damage during travel). In one example the box 43, (or cyclone 40 piping) for instance, will be maintained in a spaced relationship with respect to base frame 24 or elevated frame 26. Leg 38 connects to pivot plate in an off-set orientation in that an axis extending along the longitudinal length of leg 38 does not intersect pivot 35. Such offset due to use of pivot plate 35' also accommodates horizontal translation of tower 36 to a position closer to elevated frame 28. For instance, an axis extending along the longitudinal length of leg 38 when tower 36 is in an elevated mode is positioned closer to elevated frame 28 as compared to a vertical axis running through pivot 35. Such horizontal translation accommodates leg **38*a* contacting elevated frame 28 and provides for greater clearance or space on the remaining portion of frame 24 to receive additional material processing components when tower 36 is raised. It may be appreciated that use of pivot plate 35' minimizes or eliminates the support leg 38 from contacting base frame 24 prior to support leg 38*a* contacting rear frame 28**.

Positioned above hydrosizer is a separator 40 such as a cyclone separator configured to remove undesired or small-size materials before entering into hydrosizer 30. In one example the small-size materials of the overflow from separator 40 may include particles of −140 mesh, for instance, particles that are smaller than, or would pass through a screen of 140 mesh. A 140 mesh screen has 140 openings per linear inch. A 140 mesh screen has a sieve size of 0.105 mm (or 105 microns). Operation of a cyclone separator is commonly known. Unwanted or small-size materials are moved upward from within separator 40 and outward through a conduit 41 and into a collection box 43 or to an out-hose for disposal or subsequent treatment. An out-hose may be connected to output port 43'. In some instances the unwanted or overflow output from separator 40 is delivered to a holding pond or to a UFR (ultra fines recovery) plant or system. In one aspect the overflow from separator 40 may contain a slurry of material having fine particles of the size less than 140 mesh. This overflow may be further separated by passing the material to another separator for a finer separation, to retain particles that are 140 mesh by 350 mesh, where the −350 mesh are discarded (i.e., discarded if small enough to pass through a 350 mesh screen, for instance). The 140×350 mesh particles are considered UFR (ultra fines recovery).

An overflow port 68 is provided at hydrosizer 30. Materials may pass through overflow port 68 and also delivered to a holding pond or to a UFR plant or system. It may be appreciated that different types or sizes of materials may pass thorough overflow port 68 and output port 43' and delivered to different (or the same) processing equipment or holding ponds. In other examples collection box may be positioned at overflow port 68 to combine the materials exiting cyclone 40 and hydrosizer 30. Use of box 43 allows an operator an option of further treating the overflow from cyclone separator 40, such as to further separate the overflow.

In one aspect, at or toward the second end **22*b* of chassis 22 is a sump 44 and a dewatering screen assembly 42. Dewatering screen 42 is situated on or above sump 44. In one aspect sump 44 is a 2000 gallon capacity sump configured to hold a slurry of sand and water. It may be appreciated that sump 44 may be configured of different capacities. Sump 44 in one aspect is positioned on top of base frame 24 and may extend generally rearward such that a portion may extend on or above rear frame 28. Sump 44 may be connected (by welding, bolting or other secure fastening) to chassis 22 so that sump 44 is included on chassis 22 as chassis 22 is transported along a roadway. Having sump 44 oriented into a fixed position with respect to hydrosizer 30 and erected tower 36 accommodates for efficient set-up of sand plant 20. For instance, sump 44 is mounted into position such that it is in close proximity to hydrosizer 30 which receives the slurry from sump 44. Also, for compact location, a feed box 46 which supplies material to dewatering screen assembly 42 is positioned above sump 44 and immediately below hydrosizer 30 to conveniently receive material exiting from hydrosizer 30. Moreover, placement of screen assembly 42 at least to partially overlap sump 44 provides further compact and in-line positioning upon chassis 22. Setting sump 44 into position as shown reduces efforts for the set-up and assembly of plant 20. Setting sump 44 as shown, together with placement of hydrosizer 30 and tower structure 36 onto chassis 22, may be accomplished indoors at the manufacturing facility where a convenient crane and construction/assembly tools are available for efficient construction. Such pre-fabrication of components on chassis 22 accommodates a drastic reduction in the expense and time of set-up of a processing facility in the field. Screen assembly 42 may also be connected to chassis 22 and sump 44 for transport. Connecting screen assembly 42 to chassis 22 and sump 44 prior to transportation allows for easier set-up of plant 20 when it reaches a desired processing destination. Alternatively screen assembly 42 may be placed on sump 44 and chassis 22 after chassis 22 has been transported to a desired treating location. A feedbox 46 is positioned above dewatering assembly 42. Material or sand exiting downward through a port at hydrosizer 30 enters inlet port 47 of feedbox 46 and into assembly 42. In one aspect dewatering screen 42 is in part positioned above sump 44. Having screen 42 at least partially overlap sump 44 allows for a more compact in-line arrangement of material processing devices placed on chassis 22**.

At second end 22*b* and beneath rear frame 28 is frame suspension 32. Suspension 32 includes an axle or axles and typically a spring or other suspension mechanism. Wheels are placed on axles. Wheels accommodate portability and travel of plant 20. Plant 20 may be transported down or on a roadway to a desired location. In one aspect suspension 32 may be disconnected from chassis 22. Bolts 76 or other fasteners may be used to connect suspension 32 to chassis 22 and removed in order to remove the suspension 32. Once detached, suspension 32 may be rolled away from chassis 22.

It may be appreciated that when wheels and/or suspension 32 are removed, base frame 24 rests on a surface or the ground or on a slab 21 (such as a concrete slab) as desired. Allowing base frame 24 to rest upon the ground provides support and stability to plant 20. Jacks 48 may be utilized with chassis 22 to stabilize and further support goose neck 26 and rear frame 28. Jacks 48', such as hydraulic jacks, are also used to raise second end 22*b*, for instance, so that frame suspension 32 may be removed. Other mechanisms may also be used to raise second end 22*b*, whether connected to rear frame 28 or otherwise. It may be appreciated that alternatively air may also be removed from wheels so that base frame 24 rest on slab 20. As a further alternative wheels may be removed from axles so that base frame 24 rests on slab 20. After frame suspension 32 is removed, jacks 48' may be adjusted to lower second end 22*b* so that base frame 24 contacts ground or slab 21. Jack 48' may be adjusted so rear frame 28 is positioned generally horizontally. Jacks 48, 48' also provide additional support to rear frame 28 as may be desired. Jacks 48, 48' may also provide additional support to goose neck 26 as desired. Jack 48, 48' at first end 22*a* are used to assist removal of chassis 22 from a tractor. In one aspect with respect to FIG. 2 it is shown where the wheels extend below base frame 24 such that base frame 24 does not contact the roadway during transport. An air axle assembly may also be used with suspension 32 so that frame 28 may be raised/lowered with respect to the wheels during transportation to accommodate maneuvering of chassis 22 along roadways or upon trails having varying grades or undulations.

Placing base frame 24 directly in contact with the ground or on a slab allows plant 20 to be securely connected to the slab. Slab 21 may comprise reinforced concrete. Slab 21 may include pins which extend upward from slab. In one aspect base frame 24 includes pin ports configured to receive the pins which extend upward from slab 21. Nuts or other fastener device may be threaded upon pins to securely fasten frame 24 to slab 21. Pin ports may extend at intervals over the length and width of frame 24 to accommodate securing frame 24 along the entire length and width of the frame 24. It may be appreciated that frame 24 also includes cross supports 25 as reinforced structural support to resist flex or bending of frame 24 during transport and also for greater structural support when frame 24 is affixed to slab 21.

After base frame 24 is positioned on slab 24, cylinder 34 (or cylinders 34) activate in order to raise tower structure 36 and hydrosizer 30. Alternatively a crane or hoist or other mechanism may be used to move structure 36. When hydrosizer 30 is in an upright position, base frame 24 presents a platform or available space for receiving additional equipment for use in material processing. Such additional equipment may be transported to the field location separately and assembled onto chassis 22. It may be appreciated that such components may all be positioned in-line on chassis 22 which results in an efficient assembly and operation of plant 20. It may also be appreciated that chassis 22 and the additional devices may be preconfigured such that mounting onto chassis 22 may occur by simple bolting of the devices to the chassis. Such components and devices are configured for drop-in-place connection (i.e., the components may be modular and simply bolted into their pre-set position.

In one aspect, a primary wet screen 50 is positioned on chassis 22. Screen 50 may be located at first end 22*a*. It may be appreciated in one aspect that the components may also be reversed, with screen 50 positioned at second end 22*b* and dewatering screen 42 positioned at first end 22*a* (and hydrosizer 30 and sump 44 positioned closer to first end 22*a* if desired). A dry sand feeder 52 receives material and sand which is delivered to wet screen 50. A discharge slide 54 extends from screen 50 so that oversize materials can be removed from the system. For instance, slide 54 may project to a front side 51 of plant 20. Dry sand feeder 52 may be positioned closer to back side 53 of chassis 22. It may be appreciated that screen 50 may be positioned on chassis 22 such that discharge slide 54 extends instead to an opposite side of the chassis, i.e., screen 50 may be positioned such that discharge slide 54 is oriented toward back side 53 (See FIG. 11). Ability to switch the orientation of screen 50 accommodates flexibility in placement of plant 20 (i.e., some location may not have enough room available to load material into sand feeder 52 from the back side 53 so they may wish to configure screen 50 so sand feeder 52 is positioned toward front side 51, or vice versa. Such flexibility allows for better utilization of the space surrounding plant 20. A pipe 56 leads to a primary sump 60. If the position of screen 50 is rotated, pipe 56 may extend from an opposite side of screen 50 into sump 60. Sand material is mixed and sized with water in wet screen 50 to form a sand/water slurry. The slurry is generally fed from screen 50 to sump 60 by gravity. A pump 62 transports the slurry to a separator 70. Pump 62 may be powered by a gas engine. It may be appreciated that a sump is generally required to be used in conjunction with a pump so that a steady or constant volume of material or water or slurry is available for the pump to operate most efficiently. Separator 70 removes water from the slurry so that the slurry is of a desired consistency for efficient scrubbing at cells 72. Desired sand product drops from separator 70 into tubs or attrition cells 72 which operate as scrubbers to scrub the sand. In general, cells 72 grind the sand particles together to remove clays or other matter from the sand particles. The slurry then drops to trough 74. Trough 74 receives the slurry which exits through pipe 58 and into sump 44. In an alternative aspect pipe 58 may instead comprise a transition box which matches an output at trough 74 configured to reduce resistance that may occur at the junction of pipe 58 and trough 74. In one aspect trough 74 has a sloped bottom to assist in gravity delivery of the slurry to sump 44.

The mechanical and fluid action of the separator 40, tubs 72 and trough 74 allow for a desired flow of slurry to sump 44. A slide 75 is positioned between a bottom outlet of separator 70 to deliver the sand/slurry to tub 72. The sand/slurry delivered to tub 72 is relatively dry to accommodate scrubbing activity. Separator 70 removes water and small particles which flow upward and out through outflow pipe 71. In one aspect the outflow material from outflow pipe 71 is delivered to trough 74. Due to the nature of separator 70, overflow pipe 71 is configured to include a length which spans from above separator 70 to a position six feet (in one example) below the discharge point of separator 70. Use of a relatively long overflow pipe 71 causes separator 70 to create more vacuum (i.e., to draw material upward from separator 70) which results in a relatively dry or dense product. For instance, separator 70 causes water and smaller particles to be removed from the slurry and delivered to trough 74 where the water is remixed with the sand returning from the tubs 72 at slide 75*a*. A longer length of outflow pipe 71 presents a greater suction which tends to allow separator 70 to more readily drawn water from the slurry within separator 70. A tower structure 66 accommodates a greater length for pipe 71. A rubber boot 79 at the bottom of separator 70 also tends to hold sand at the bottom location of separator which also tends to compact the sand for a denser discharge out the bottom of separator 70 and prior to entry into tub 72. When a large enough mass of sand builds up at boot 79, the boot will flex to allow the sand to release from boot 79 and enter slide 75. In one aspect separator 70 includes a tower structure 66 configured to hold separator 70 at a desired position above trough 74 and/or tubs 72. Separator 70 is oriented generally vertically for most efficient operation. The tower structure 66 and struts 73 accommodate such vertical orientation and positioning of separator 70 to efficiently deliver sand to subsequent components of plant 20. It may be appreciated that platform 77 is oriented in an elevated position above base frame 24 by struts 73. In one aspect, platform 77 and struts are bolted into position upon chassis 22.

Figure 8:
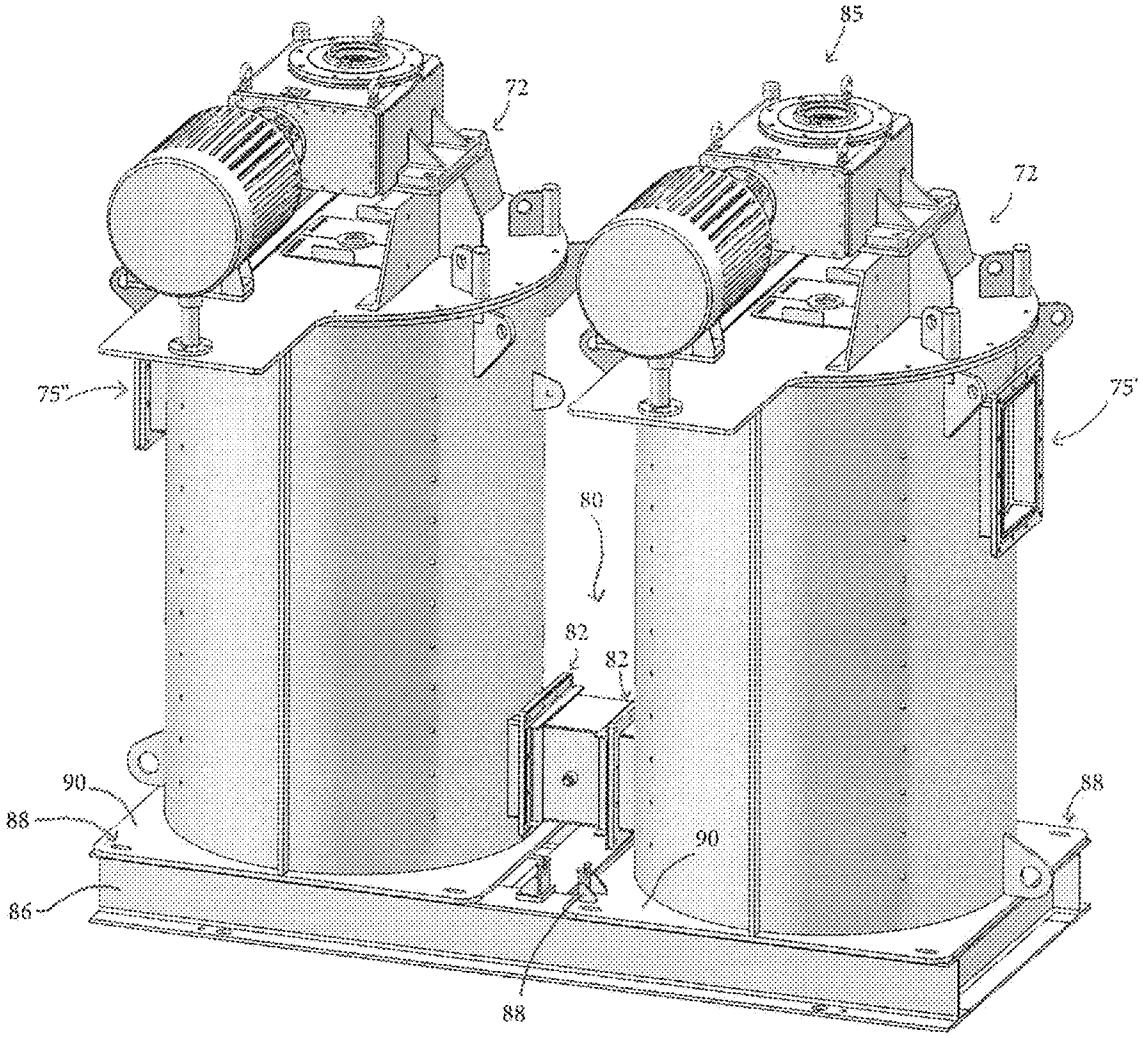
FIG. 8 is a perspective view of a feature for use in conjunction with the processing plant of the present invention.

In one aspect with reference to FIG. 4 and FIG. 8, the sand material slides down slide 75 from separator 70 into tub or attrition cell 72, such as through slide port 75', where it is scrubbed. The material is scrubbed to remove clays and organics or other unwanted materials from the sand particles. Inside tub 72 the material is scrubbed and circulated and flows through box 80 where it enters another attrition cell or tub 72 for further scrubbing and circulation. The sand exits the second tub 72 at port 75" where it slides down slide 75*a* and into trough 74 for delivery to sump 44.

As shown at FIG. 8, box 80 provides a path through which sand travels from a first scrubber 72 to a second scrubber 72. Box 80 may comprise a metal conduit and in one aspect includes a rubberized layer to protect the inner metal surfaces. It may be appreciated that the rubberized layer wears over time due to the friction and passage of sand or other materials through box 80. In one aspect, box 80 includes a box joint 82 where box 80 connects to a flange of an attrition cell port. Box 80 may be fastened, by bolts for instance, to the flange and removed as desired. In one aspect a gasket may be placed between box 80 and flange to prevent leaking. A box joint 82 may be included at opposite sides of box 80 so that box 80 may be connected and disconnected from each of the attrition cells 72, 72. It may be appreciated that removal of box 80 can be difficult or nearly impossible to accomplish without first separating or sliding apart the attritions cells 72, 72 from each other (or sliding them further away from each other). In one aspect of the invention each cell 72 is associated with a separate cell plate 90. For scrubbing module 85, each cell 72 is connected to an individual cell plate 90 which is in turn connected to a support 86 of the module 85. Support 86 may also comprise platform 77, or vice versa. In one aspect, cell plate 90 includes an elongated slot 88 or elongated slots which receive fasteners that extend through slot 88. A nut secures plate 90 in position on support 86. It may be appreciated that plate 90 may slide when the nut or nuts are loosened upon threaded fasteners which extend through elongated slots. As respective plates 90 slide away from each other, the distance between cells 72, 72 increases, thereby allowing for separation of box 80 from respective joints 82 for removal of box 80. After box 80 is repaired or replaced, cells, 72, 72 (or a single cell 72) may be moved to close the gap or shorten the distance between cells 72, 72. The pins running through slots 88 may be securely fastened upon support 86 with nuts or other connector. It may also be appreciated that a bracket 88 may be connected to plate 90 and another bracket connected to support 86, for instance, to accommodate adjustment of respective plates 90. For instance, a threaded pin or worm gear may be positioned between respective brackets 88 so that a user may rotate the pin to accomplish lateral sliding of plate 90 and resulting adjustment or positioning of the respective cells 72. It may be appreciated that adjustment of a single cell 72 may be accomplished to remove box 80 or adjustment of both cells 72, 72 may be utilized. It may also be appreciated that scrubbing module 85 may be picked up and placed onto position on scrubbing platform 87 as a single unit.

Various additional or substitute components may be used in conjunction with chassis 22. The components added to chassis 22 comprise a material processing system of the invention. Because tower structure 36 raises to expose usable space at base frame 24, and because base frame may be positioned directly on the ground of on a slab 21, additional components may be added to chassis without unduly compromising the balance and stability of chassis 22 and operation of the system. The chassis and additional components may be modularly configured for efficient assembly/construction. The additional components may also be positioned in-line for efficient operation. The open arrangement of base frame 24 when tower 36 is raised allows for efficient assembly (and disassembly) of plant 20. Such efficient and compact arrangement is also intended to enhance performance of the sand treating operation. The arrangement accommodates an in-line process. Components are spaced in close proximity with each other and oriented to utilize gravity as much as possible. Having a base frame 24 which is positioned on the ground allows for a lower orientation of sump 44 which in turn assists in creating a lower profile structure to conveniently utilize gravity in the process. Orienting a bottom of sump 44 to be positioned below a top surface 29 of rear frame 28 allows for other components to be positioned closer to the ground or slab. For instance, placing sump 44 on base frame 24 which is lower than gooseneck 26 and rear frame 28 allows trough 74, tubs 72 and separator 70 to be positioned relatively low while continuing to utilize gravity to assist transport or circulation of the sand/slurry. Utilizing the open space on frame 24 when tower 36 is erected allows the separate modules or material processing devices to be efficiently placed and stabilized in-line on a frame structure secured to the ground or slab 21, and allows close placement to the hydrosizer 30 and adjacent components. The in-line arrangement provides efficient use of available land/space at the processing location. Unlike many processing operations where components may radiate from the hydorciser in different and unpredictable directions and may span relatively long distances and occupy a rather large footprint, the components of the present system have a pre-arranged in-line and efficient location and are configured for ease of assembly.

Pump 64 transports the slurry of sand and water from sump 44 upward to separator 40. Pump 64 may be powered by an engine. Struts 73 may be used to elevate trough 74, attrition cells 72 and separator 70 as shown. In one aspect struts 73 allow for efficient flow of slurry to sump 44 by use of gravity and/or without separate pumps for delivery.

When the chassis 22 has been fastened to slab 21 and tower 36 has been erected, additional modules or components are connected to form plant 20. Scrubbing module 85 (See FIG. 8) may be picked up (by a crane or otherwise) and placed on scrubbing platform 87. Separator 70 and tower structure 66 may be picked and placed onto platform 87. Sump 60 may be picked and placed onto frame 24. Primary wet screen 50 may be picked and placed onto frame goose neck 26.

Figure 5:
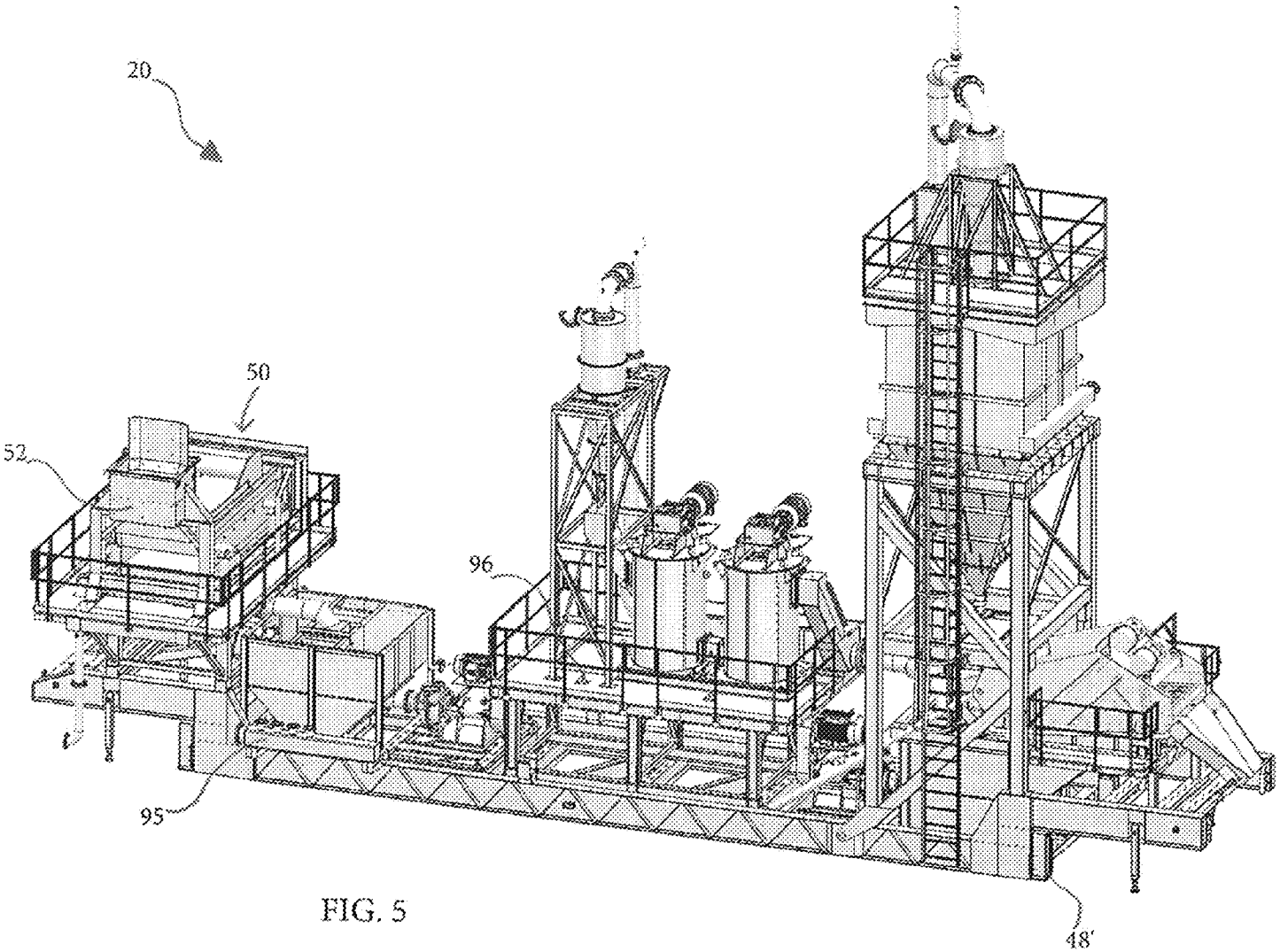
FIG. 5 is a reverse perspective view of the processing plant of FIG. 3.
Figure 6:
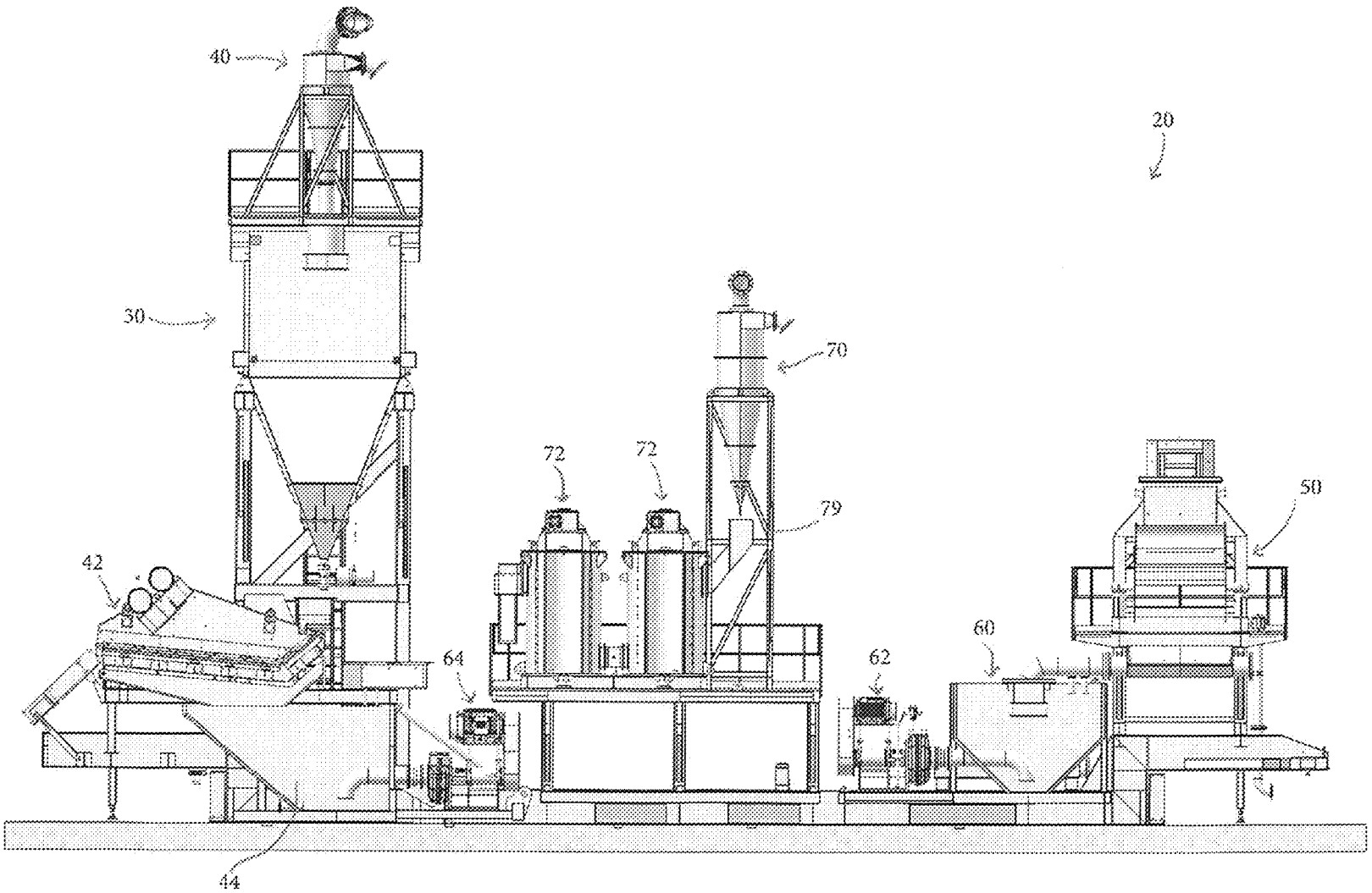
FIG. 6 is a cross-section view taken along line 6-6 of FIG. 3.

FIG. 5 presents a reverse angle perspective view of plant 20, showing the various components mentioned herein. A water intake manifold 95 is connected to chassis 22 and is configured to receive water for operation of the systems and methods of the invention. Supply lines which travel from a pond or other water source may connect to manifold 95 for subsequent delivery of water to the various components of plant 22. It may be appreciated that separate water supply lines may also be configured to supply water directly to components (such as primary wet screen 50 or other components) without having to draw water only from manifold 95. A lift hook such as hook 96 (or multiple hooks 96) may be included on platform 77 for ease of picking and placing platform into position on chassis 22. Plant 20 is equipped with various safety rails, ladders and other equipment.

Figure 9:
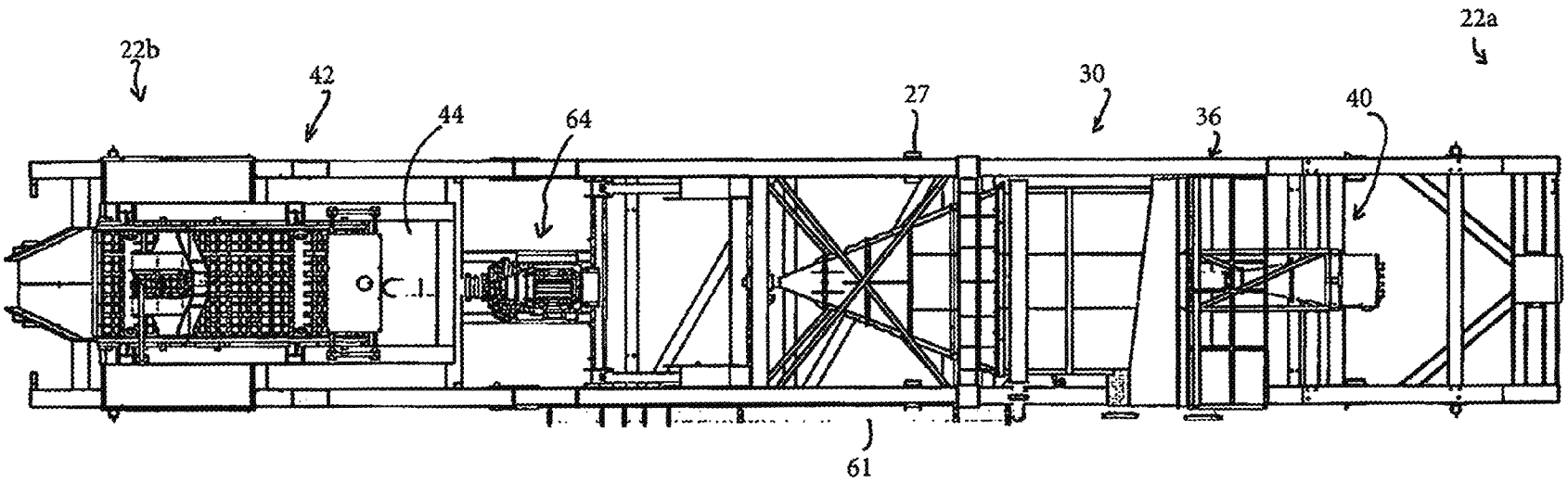
FIG. 9 is a top view of the material processing plant of FIG. 1 with a component arranged in a horizontal position.
Figure 10:
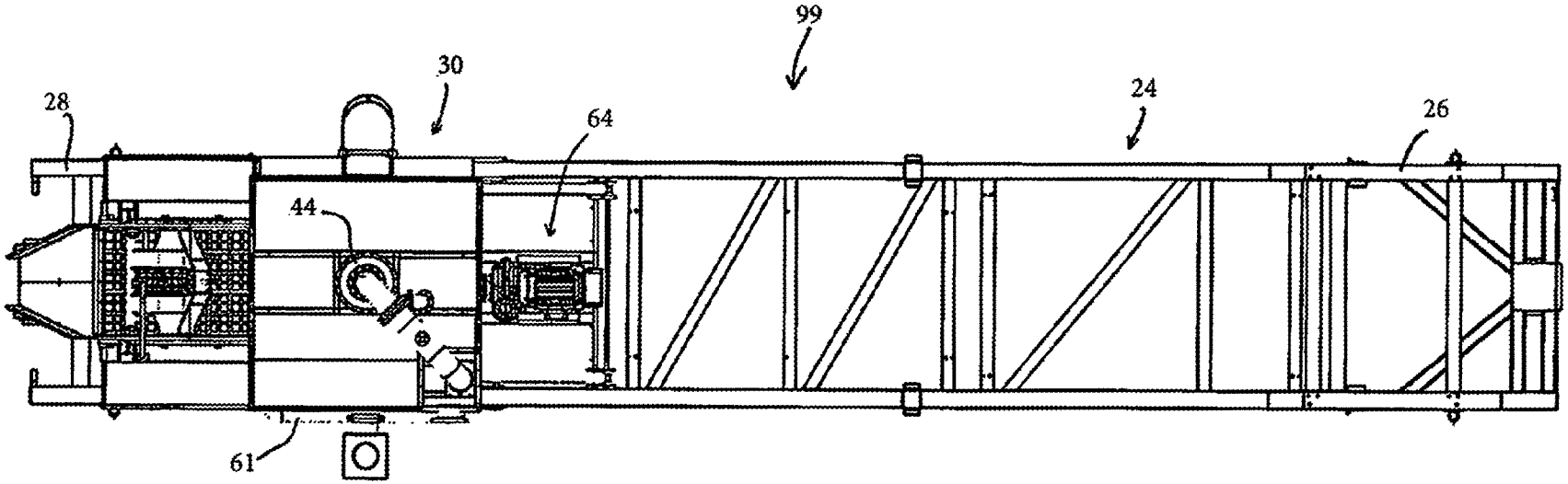
FIG. 10 is a top view of the material processing plant of FIG. 1 with a component arranged in a vertical position.
Figure 11:
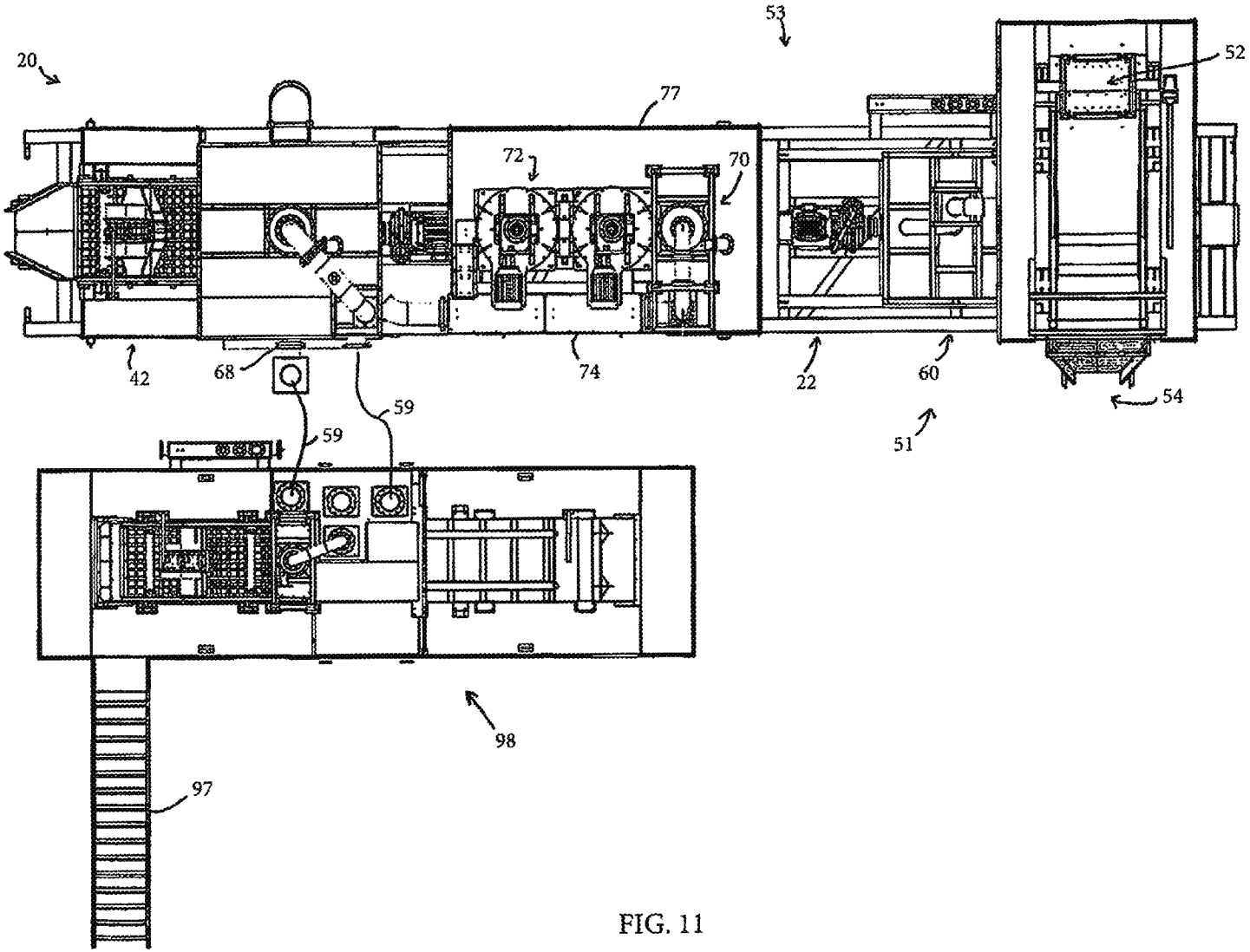
FIG. 11 is a top view of a material processing plant in accordance with an aspect of the present invention.
Figure 12:
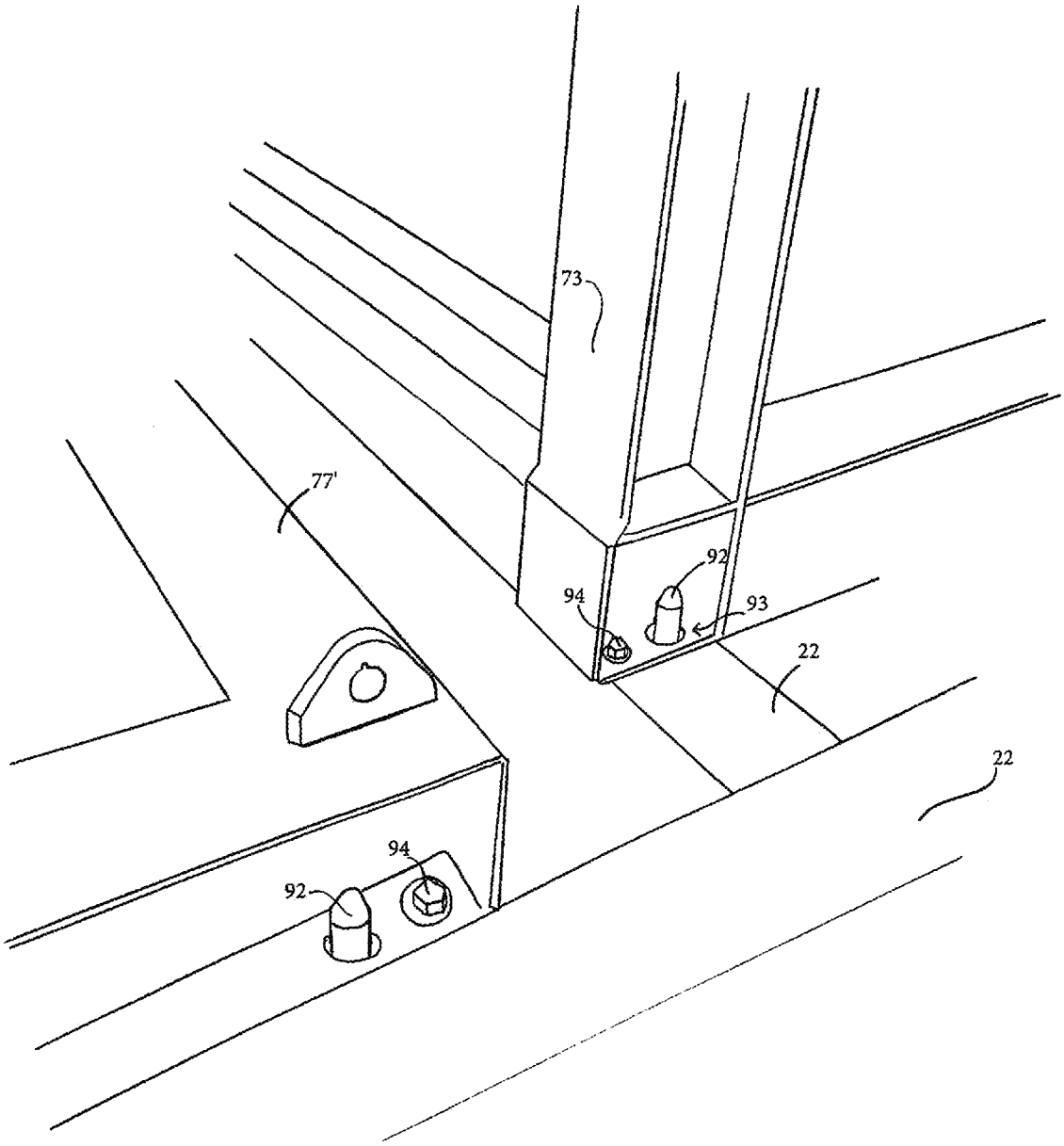
FIG. 12 is a partial perspective view of component features in accordance with an aspect of the present invention.

FIG. 9, FIG. 10 and FIG. 11 show top view aspects of the present invention. FIG. 9 shows chassis 22 with hydrosizer 30 and structure 36 in a lowered position upon chassis 22. FIG. 10 shows chassis 22 with hydrosizer 30 and structure 36 in an elevated position. It may be appreciated that a vast space 99 is available upon chassis 22 at base frame 24 and at goose neck 26 for placement of material processing devices. It may also be appreciated that placement upon chassis at space 99 allows for in-line arrangement of devices sufficient for a sand processing operation, while also maintaining abundant ground areas surrounding chassis 22 for placement of additional equipment or general clearance for maneuvering around chassis 22. In one aspect a supplemental treatment facility 98 is positioned adjacent chassis 22 to enhance plant 20. Facility 98 may be used to further separate material such as sand. For instance, the overflow material from hydrosizer 30 which exits port 68 may flow to a sump at facility 98. The overflow may transport through hose 59. A pump will deliver the overflow slurry to a screen for further separation, allowing the separated sand to discharge along a conveyor 97, for instance. It may be appreciated that overflow from separator 40 may transport from box 43 through pipe or hose 59 to a second sump of facility 99. The slurry may be pumped to a further screen for further separation of the materials. In this configuration multiple separations and grades of sand can be captured and separated in an efficient manner and with minimization of footprint of the work site.

The processing components of the present system may be bolted into position, thus avoiding expensive welding or other construction. Each module or component may be configured with hooks to be picked and placed into position on chassis 22 or upon platform 77. As shown with reference to FIG. 12, quick-position or alignment pegs 92 and bolt 94 arrangements are used for ease of setting and bolting components to chassis 22 and in space 99. For instance, a peg 92 may project from chassis 22 (or from a cross-support of chassis 22). A strut 73 may include a peg hole 93 which receives peg 92 for ease of alignment of strut 73 on chassis 22. Once strut 73 (or an entire component such as platform 77) is set in position on chassis 22 (via easy alignment where a number of pegs 92 set through peg hole 93 such that the strut 73 abuts directly to chassis 22, for instance) a bolt 94 may be secured into pre-set bolt holes formed in chassis 22. The positioning of the pegs 92 and respective peg holes 93 and bolt holes allow an operator to efficiently and accurately place the components in the field. No welding or special measuring is required, further making the construction of plant 20 efficient. In a further aspect, a platform 77', such as may hold a pump 64 upon chassis 22, may also be connected to chassis with quick-position pegs 92 and bolts 94. Such features allow for fabrication of device modules in a manufacturing plant for ease of use in the field. Moreover, the manufacture may occur during the winter months and constructed when the weather breaks for speed of set-up. This allows a surprising benefit of speed to set-up in the springtime so that sand processing can begin as soon as possible when the thaw breaks (allowing for truck travel on roadways).

In one method aspect, chassis 22 is prepared in a shop and preconfigured with hydrosizer 30 within tower structure 36 and pivotally connected to chassis 22. Sump 60 is fastened to chassis 22 and screen assembly 42 is optionally connected by placement at least partially over sump 44. The remaining components are prepared for modular and in-line assembly or connection onto chassis 22. Thereafter, sand plant 20 is transported to a field site typically by a tractor truck. Chassis 22 may be a truck towable chassis or trailer. The plant 20 may be pulled down a highway and meets conventional regulations of the department of transportation so that special permits are not required (at least in some jurisdictions) for the transport. The site is prepared with a slab 21 if desired. In one instance slab 21 includes pins or threaded pins extending upward from slab 21 (such as steel or rebar or other devices extending upward through a concrete slab) or other connecting devices associated with a slab. Plant 20 may be secured to the pins or fastening devices so that it is securely mounted to slab 20. Once plant 20 is positioned and/or mounted at slab 21 or a desired location, first end **22*a* is lowered such that at least a portion of base frame 24 contacts the ground or slab 21. To do so it may be appreciated that jack 48' at first end 22*a* is activated to support the weight of end 22*a* while goose neck 26 is disconnected from the tractor truck. In one aspect, second end 22***b* may be raised momentarily to disconnect goose neck 26 from the truck. Thereafter, once the truck is removed, goose neck 26 is lowered such that base frame 24 may at least in part contact slab 21. Second end 22*b* is then lowered such that the entire or substantially the entire base frame 24 rests upon the ground or on the slab 21. Frame 24 may then be connected to slab 21. Alternative sequences may be followed for raising and lowering chassis and removal of the wheels so that base frame 24 (or at least part of base frame 24) rests on the ground or on a slab.

Figure 7:
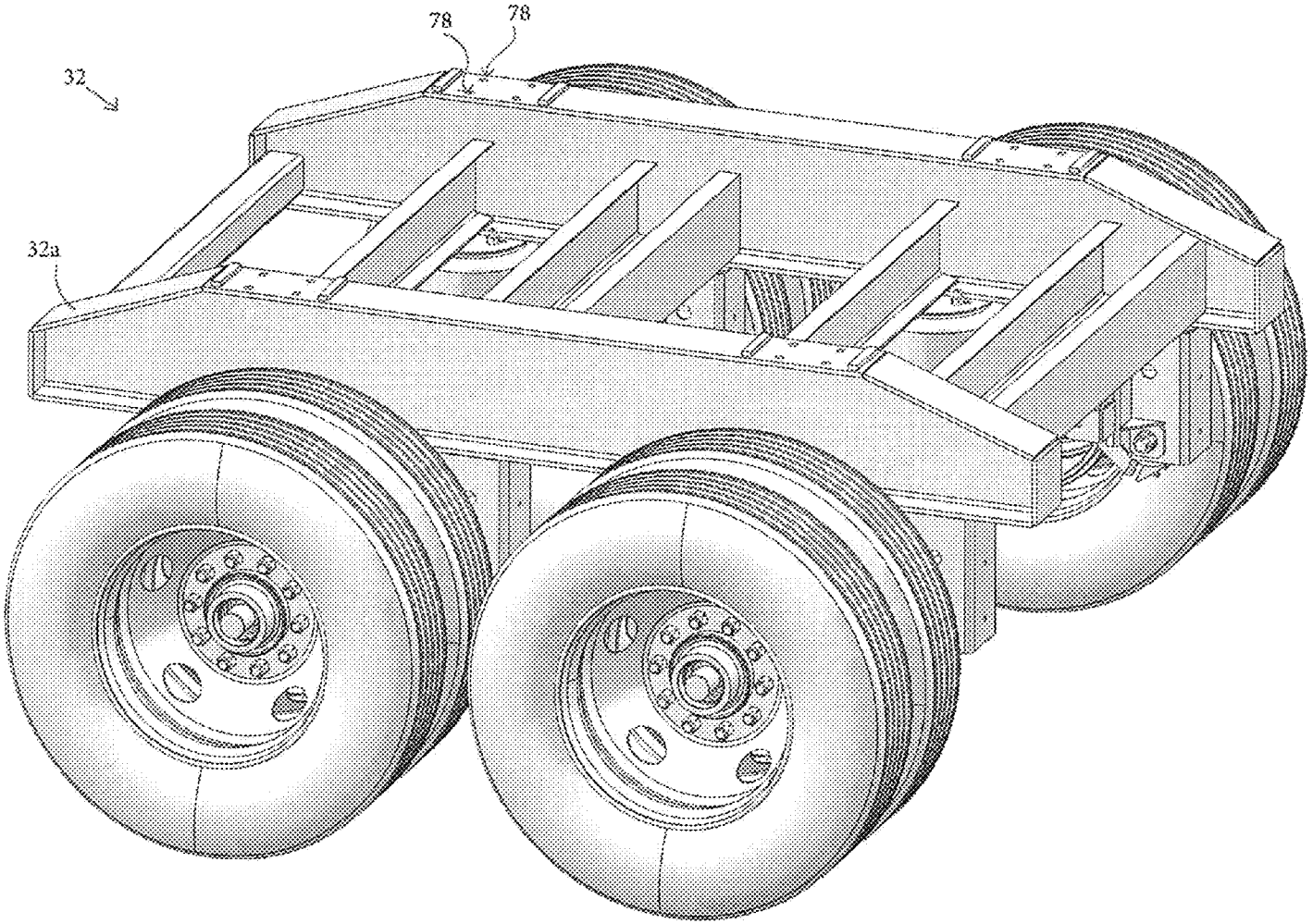
FIG. 7 is a perspective view of a feature for use in conjunction with the processing plant of the present invention.

In one aspect end 22*b* may be raised by use of jacks 48'. Activating jacks 48' raises end 22*b* which relieves force acting upon frame suspension 32. Reducing the force applied to frame suspension 32 allows for frame suspension 32 to be removed from chassis 22. In one aspect, bolts 76 which connect suspension 32 to rear frame 28 are removed from bolt holes 78 to allow for disconnection. As shown in FIG. 7, a pattern of bolt holes 78 may be established on a frame 32*a* of frame extension 32. A bolt 76 passes through rear frame 28 and through bolt holes 78 to secure suspension 32 to a position beneath rear frame 28. It may be appreciated that a variety of bolt patterns may be used, and that alternative fasteners or fastening mechanisms may be used to allow suspension 32 to be removed from or connected to chassis 22. Once suspension 32 is disconnected from frame 28 it may be wheeled away for storage or for subsequent reconnection and transport. After suspension 32 is removed, second end 22*b* is lowered, for instance, by operating jacks 48. Once second end 22*b* is lowered, the entirety or substantially the entire base frame 24 rests upon the ground or on the slab 21. Base frame 24 also includes bolt holes positioned in heavy duty beams. Concrete may be drilled for insertion of wedge anchor bolts which run through frame 24 into the anchors/slab to secure plant 20. Such anchoring provides additional overall stability to plant 20, including desired stability especially due to the height of hydrosizer 30 and the potential to capture the wind. While in operation the weight of hydrosizer 30 will tend to provide sufficient stability, yet when hydrosizer 30 is not in operation or empty, it is desired to have the additional stability where chassis 22 is bolted to the ground.

While the Figures depict plant 20 having wheels and suspension 32, it may be appreciated that the wheels and frame suspension 32 are not required in order to rest base frame 24 on the ground. Having base frame 24 on the ground enhances the stability of the chassis and allows for use of several components for use in the processing of the sand. The resting on the ground enhances support for use of a taller hydrosizer 30 and the additional components such as screens, sumps, separator, attrition cells, pumps and related connectors, conduits and accessories.

In a further aspect the invention includes a method of utilizing a sand plant 20 having a chassis 22 configured to support a tip-up hydrosizer 30 together with additional components for use in a sand preparation operation. One aspect of the method includes utilizing a sand plant 20 having a chassis 22 which rests directly on the ground and where the chassis 22 supports the processing equipment. The processing equipment may include components as stated above. The method further includes raising the chassis 22 in order to provide clearance for connection with a suspension, for instance a suspension such as suspension 32. Chassis 22 may be raised by any means. In one aspect chassis 22 is raised by use of jacks 48'. Suspension 32 may be connected to rear frame 28 to support second end 22*b* and accommodate transportation of plant 20 from site to site for subsequent sand processing operations.

In operation, after the method of set-up of sand plant 20 is accomplished with erected hydrosizer and added components and conduits noted or desired, in one aspect sand is delivered to primary wet screen 50 to process the sand into a wet slurry. Water is added to the sand and undesired sizes of sand and other particles are removed at this stage. The sand travels to primer sump 60. A pump 62 transports the slurry from sump 60 to separator 70 to remove excess water and materials to condition the slurry for use in attrition cells 72. A hose or conduit generally represented by line 57 may be used to transport the slurry. The slurry transitions from cell 72 to cell 72 and to trough 74 and then into sump 44. A pump 64 pumps the slurry from sump 44 to an input port 45 of cyclone separator 40. A hose or conduit generally represented by line 59 may be used to transport the slurry. Separator 40 separates the slurry into desired sand which drops to hydrosizer 30 while the lighter undesired particles and liquid raise upward and to conduit 41 for disposal or further treatment. The sand exits a port at the bottom of hydrosizer 30 and into feed box 46 and then into dewatering screen assembly 42. Dewatering assembly de-waters the sand. The sand may be discharged through a discharge chute 49.

When a sand processing operation is completed at a given site the portable sand plant 20 may be transported to a new site. The various components, or some of them (such as primary wet screen 50, primary sump 60, separator 70, tubs 72, trough 74 and a pump 62, for instance), are removed from the chassis 22, the hydrosizer 30 is adjusted so that it lay upon base frame 24. A U-cradle 27 is positioned on a rail of chassis 22 such as at base frame 24. U-cradle 27 receives a support leg 38 of tower structure 36. U-cradle 27 assist to align leg 38 and stabilize leg 38 (and tower 36) for transport. Multiple U-cradles 27 may be used. In one aspect u-cradle 27 prevents hydrosizer 30 or cyclone separator 40 or related parts from contacting chassis 22 directly, thus reducing the forces that might otherwise impact hydrosizer or other components during transportation.

In a further aspect of the material processing method, a first material processing device is moved from a generally horizontal orientation above a portable chassis 22 to a generally vertical orientation above the chassis 22. A second material processing device is positioned on the chassis at a position previously occupied by the first material processing device. The second material processing device is configured to process material to be supplied to the first material processing device. In one aspect the first material processing device is a hydrosizer 30. Other material processing devices may be utilized as the first material processing device. In one aspect a second material processing device may include one from a group including attrition cells, separators, sumps, pumps, dewatering screens, watering screens or separators, or other material processing equipment. In one aspect the second material processing device includes a wet screen 50 which is placed on the chassis 22. In another aspect the second material processing device includes at least one attrition cell 72 which is placed on base frame 24 of chassis (or on platform 77 which is connected to base frame 24). The devices are aligned in-line along chassis 22. The devices are bolted into position. Additional material processing devices may also be positioned on a platform extending upward from the vacated space.

The present invention provides a compact system for complete processing of sand. The system is easy to assemble and operate and results in sand being completely processed utilizing only the components positioned on the chassis. Removal of any of the key components from the system would result in an unfinished end product or product requiring further treatment. Positioning the key components (primary wet screen, at least one scrubber or attrition cell, hydrosizer and dewatering screen) on a single chassis which is also configured to transport at least the hydrosizer, presents a compact or small footprint which allows for convenient positioning of supplemental treatment facilities in close proximity. Configuring the hydrosizer 30 to tip into position on a transportable chassis greatly reduces the construction cost and set-up time of a plant, and configuring a pre-set area on the chassis for additional processing equipment for in-line and gravity assisted processing of sand adds further value and benefits. The system may be easily disassembled, transported, and reassembled for subsequent use.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise specifically indicated. While the particular PORTABLE SAND PLANT SYSTEMS AND METHODS as herein shown and described in detail is fully capable of attaining the above-described aspects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

What is claimed is:

1. A material processing method comprising:

adjusting a first material processing device by moving the first material processing device from a generally horizontal orientation above a portable chassis to a generally vertical orientation above the portable chassis; and positioning a second material processing device on the portable chassis at a position previously occupied by the first material processing device, the second material processing device configured to process material to be supplied from the second material processing device to the first material processing device.

2. The method of claim 1 where the portable chassis is configured to connect to a truck for transportation and where the first material processing device comprises a cone-shaped hydrosizer configured to separate sand material, said method further comprising positioning a base frame of the portable chassis on a surface and where said adjusting step includes pivoting the first material processing device from the generally horizontal orientation to the generally vertical orientation.

3. The method of claim 1 where the first material processing device is a hydrosizer configured to separate sand and the second material processing device is an attrition cell configured to scrub sand, said method further comprising lowering the portable chassis to a surface prior to said adjusting the hydrosizer and positioning a wet screen and a dewatering screen on the portable chassis to process sand, said method providing complete processing of sand used for hydraulic fracturing.

4. The method of claim 1 where the first material processing device comprises a cone-shaped hydrosizer configured to separate sand material and where said adjusting includes positioning the hydrosizer above a feed box configured to receive material from the hydrosizer, the feed box configured to supply material to a dewatering screen module positioned on the portable chassis.

5. A material processing method comprising:

adjusting a first material processing device by moving the first material processing device from a generally horizontal orientation above a portable chassis to a generally vertical orientation above the portable chassis; and positioning a second material processing device on the portable chassis at a position previously occupied by the first material processing device, the second material processing device configured to process material to be supplied to the first material processing device where the second material processing device comprises one from a group of an attrition cell, a cyclone separator, a sump.

6. The method of claim 1 further comprising placement of the portable chassis on a ground surface and where said positioning of the second material processing device includes placement of the second material processing device on a platform elevated from the portable chassis.

7. The method of claim 1 where the first material processing device comprises a cone-shaped hydrosizer configured to separate sand material and where said adjusting includes positioning the hydrosizer above a sump configured to supply material to the hydrosizer, said positioning of the second material processing device includes placement of the second material processing device at or above a top level of the sump.

8. The method of claim 7 where the second material processing device includes a cyclone separator, the method further comprising positioning at least one attrition cell, at least one pump, and a sump at the position previously occupied by the first material processing device.

9. The method of claim 8 further comprising positioning a primary wet screen at a first end of the portable chassis opposite a dewatering screen which is positioned at a second end of the portable chassis.

10. A material processing system comprising:

a first material processing device pivotally engaged upon a portable chassis, said first material processing device configured to pivot from a generally horizontal orientation at a first position above said chassis to a generally vertical orientation above said chassis;

a second material processing device positioned on said chassis at said first position, said second material processing device configured to process material to be supplied from said second material processing device to said first material processing device; and a pump in communication between said second material processing device and said first material processing device.

11. The material processing system of claim 10 where said first material processing device is a cone-shaped hydrosizer configured to separate sand material and said second material processing device includes a cyclone separator, said system further comprising: at least one attrition cell and a sump positioned at the first position.

12. The material processing system of claim 10 where said first material processing device is a cone-shaped hydrosizer configured to separate sand material and said second material processing device is positioned on a platform elevated from the chassis.

13. The material processing system of claim 10 where said first material processing device is a cone-shaped hydrosizer configured to separate sand material and is positioned above a sump when said hydrosizer is in the vertical orientation, said second material processing device positioned at or above a top level of said sump.

14. A material processing system comprising:

a first material processing device pivotally engaged upon a portable chassis, said first material processing device configured to pivot from a generally horizontal orientation at a first position above said chassis to a generally vertical orientation above said chassis; and a second material processing device positioned on said chassis at said first position, said second material processing device configured to process material to be supplied to said first material processing device where said chassis is configured to connect to a truck to transport said chassis on a roadway, said first material processing device being a hydrosizer mounted to a tower structure rotatably connected to said chassis such that said hydrosizer is moveable from a horizontal orientation to a vertical orientation.

15. The system of claim 14 where said chassis includes a base frame configured to be positioned on a ground surface, said hydrosizer moveable from the horizontal orientation to the vertical orientation, and vice versa, while said base frame is positioned on the ground surface.

16. The system of claim 14 where said chassis includes a base frame and a first elevated frame, said first elevated frame includes a top surface positioned above said base frame, said tower structure having a first support leg connected to said chassis at a pivot and a second support leg oriented to contact said elevated frame.

17. The system of claim 14 further comprising a sump connected to said chassis such that said hydrosizer aligns adjacent said sump when said hydrosizer is in the horizontal orientation and said hydrosizer aligns over said sump when said hydrosizer is in the vertical orientation.

18. The system of claim 14 further comprising a material processing device positioned on said chassis at a position previously occupied by said hydrosizer when said hydrosizer was in the generally horizontal orientation, said material processing device configured to process material to be supplied to said hydrosizer.

19. The system of claim 18 where said second material processing device includes a cyclone separator, said system further comprising:

at least one attrition cell;

at least one pump; and a sump positioned at the position previously occupied by said hydrosizer; and a primary wet screen positioned at a first end of said chassis opposite a dewatering screen which is positioned at a second end of said chassis.

20. The system of claim 18 where said chassis includes a base frame configured to be positioned on a ground surface and said material processing device comprises a bolt-on material processing device elevated by a platform positioned at the position previously occupied by said hydrosizer.

21. The system of claim 10 where said first material processing device is a cone-style hydrosizer, said chassis configured to receive a wet screen to separate sand at one end of said chassis, a dewatering screen at an opposite end of said chassis configured to receive sand from said hydrosizer, and at least one attrition cell between the wet screen and the hydrosizer and configured to receive sand processed at the wet screen and to release sand to be processed at said hydrosizer.

22. The system of claim 10 where said first material processing device is a hydrosizer, said system further comprising:

a wet screen positioned at a first end of said chassis; and at least one attrition cell in communication between said wet screen and said hydrosizer, said attrition cell configured to receive sand processed at said wet screen and to release sand to be processed at said hydrosizer.

* * * * *